United States Patent [19]

Iwabuchi

[11] Patent Number: 4,502,252

[45] Date of Patent: Mar. 5, 1985

[54] LAPPING MACHINE

[75] Inventor: Masaburo Iwabuchi, Yokohama, Japan

[73] Assignee: Tokyo Shibaura Denki Kabushiki Kaisha, Kawasaki, Japan

[21] Appl. No.: 479,471

[22] Filed: Mar. 28, 1983

[30] Foreign Application Priority Data

Mar. 29, 1982 [JP] Japan ..... 57-50819

[51] Int. Cl.[3] ..... B24B 5/00

[52] U.S. Cl. ..... 51/118; 51/131.2; 51/131.4; 51/132; 51/215 UE

[58] Field of Search ..... 51/117–118, 51/215 UE, 129, 131.1–131.4, 132; 198/485

[56] References Cited

U.S. PATENT DOCUMENTS

| | | | |
|---|---|---|---|
| 1,465,117 | 8/1923 | Dey | 51/131.1 |
| 3,443,342 | 5/1969 | Schulz | 51/131.2 |
| 3,568,371 | 3/1971 | Day et al. | 51/132 X |
| 3,668,813 | 6/1972 | Barragan | 51/215 UE X |
| 3,691,694 | 9/1972 | Goetz et al. | 51/118 X |
| 3,889,428 | 6/1975 | Steinegger et al. | 51/117 X |
| 3,970,471 | 7/1976 | Bankes et al. | 51/118 X |

OTHER PUBLICATIONS

E. Mendel et al., "Multiple-Water Free Polishing Part I, Machine Concepts", 1979, ECS.

E. Mendel et al., "Multiple Wafer Free Polishing Part II Process", 1979, ECS.

E. Mendel et al., "Pad Materials for Chemical Mechanical Polishing", 1979.

*Primary Examiner*—James G. Smith

*Assistant Examiner*—Debra S. Meislin

*Attorney, Agent, or Firm*—Finnegan, Henderson, Farabow, Garrett & Dunner

[57] ABSTRACT

In a lapping apparatus, washing water is ejected from washing water holes toward a carrier holding wafers after the wafers are polished. Thus, the wafers are separated from the carrier and upper and lower polishing members. Then, the carrier is forced up above the upper polishing member by a pushing ring. The wafers left on the upper member are carried onto a table by a first sweeper of an automatic collecting device. The transferred wafers are arranged in a line along a second sweeper. Then, the second sweeper pushes and moves the wafers in the direction of their arrangement toward a cassette on one side of the table. The wafers are housed in holder portions in the cassette, and are then immersed, along with the cassette, in a pure water tank.

12 Claims, 2 Drawing Figures

LAPPING MACHINE

BACKGROUND OF THE INVENTION

This invention relates to a lapping machine for simultaneously polishing both faces of objects of lapping.

As the degree of integration of IC devices increases, wafers for the IC devices and other objects of lapping need to be smoothly and very accurately polished on both sides. For high-accuracy wafer polishing, lapping apparatuses which simultaneously polish the two faces of each wafer are conventionally used. In one such lapping apparatus, wafers are held between upper and lower lapping plates (each pasted with a pad) so as to be fitted in holes in a carrier, and are polished with a flatness error of 1.00 μm or less.

In the prior art lapping apparatus of this type, however, the polished wafers are manually removed from the apparatus and collected in a cassette. Accordingly, the lapping apparatus for simultaneously polishing the two faces of each object has the following drawbacks.

First, the polished wafers are left adsorbed on the upper and lower lapping plates, so that it is difficult to remove the wafers from the plates by hand after polishing.

Secondly, the wafers laid on the carrier after polishing are substantially equal in thickness to the carrier, and are fitted in the holes in the carrier. It is therefore hard to remove the wafers manually from the holes, requiring much time and labor.

Thirdly, the surfaces of the wafers, after polishing, are activated and untouchable. At the time of removal, therefore, the wafers need to be held by their edges. Thus, the removal of the wafers from the lapping apparatus is very low in working efficiency, requiring much time and labor.

Finally, the wafers are exposed to the air for a relatively long time due to their prolonged removal from the lapping apparatus. Thus, the surfaces of the wafers may suffer oxidation or the adhesion of dust or other foreign substances.

SUMMARY OF THE INVENTION

An object of this invention is to provide a lapping apparatus in which objects of lapping, after undergoing bilateral polishing, can be automatically transferred from the apparatus to a cassette without being touched directly by an operator's hand.

Another object of the invention is to provide a lapping apparatus capable of quickly and easily storing objects of lapping after the objects are polished on both sides.

According to an aspect of the invention, there is provided a lapping apparatus for simultaneously polishing and lapping opposing faces of objects, which comprises a rotatable lower lapping plate, having a carrying surface to carry the objects, and having thereon a first polishing member to polish one face of each object; a rotatable upper lapping plate having a second polishing member to polish the other face of each object, the upper lapping plate being capable of abutting against the other faces of the objects laid on the first polishing member; washing water supply means formed in one of the two polishing members and capable of supplying washing water to the objects; a carrier having holes to hold the objects and capable of being set on the carrying surface of the first polishing member, whereby the objects are retained on the carrying surface; a carrier transfer mechanism for lifting up the carrier from the carrying surface after polishing and lapping, leaving the objects lying on the carrying surface; a cassette disposed close to the lower lapping plate to house the objects; and collecting means adjacent the lower lapping plate, including a first sweeper for arranging the objects on the carrying surface in a line and a second sweeper for moving the objects along the line toward the cassette.

DETAILED DESCRIPTION OF THE PREFERRED EMBODIMENT

An embodiment of this invention will now be described in detail with reference to the accompanying drawings. In this embodiment, silicon wafers (hereinafter referred to simply as wafers) are used as objects of lapping or polishing.

Figure 1:
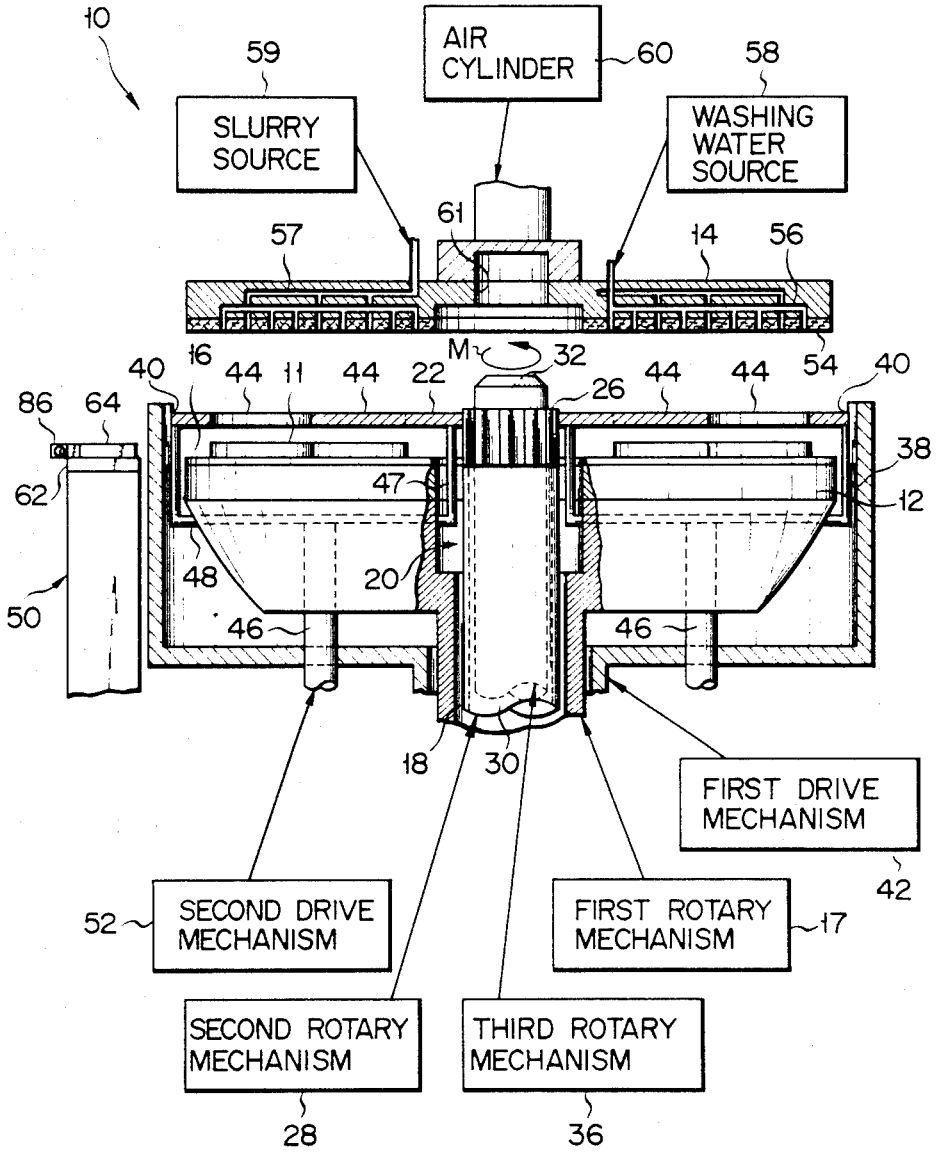
FIG. 1 is a schematic sectional view of a lapping apparatus according to one embodiment of this invention.

As shown in FIG. 1, a lapping apparatus 10 comprises lower and upper lapping plates 12 and 14, respectively, each having an annular surface and facing each other for rotation.

Figure 2:
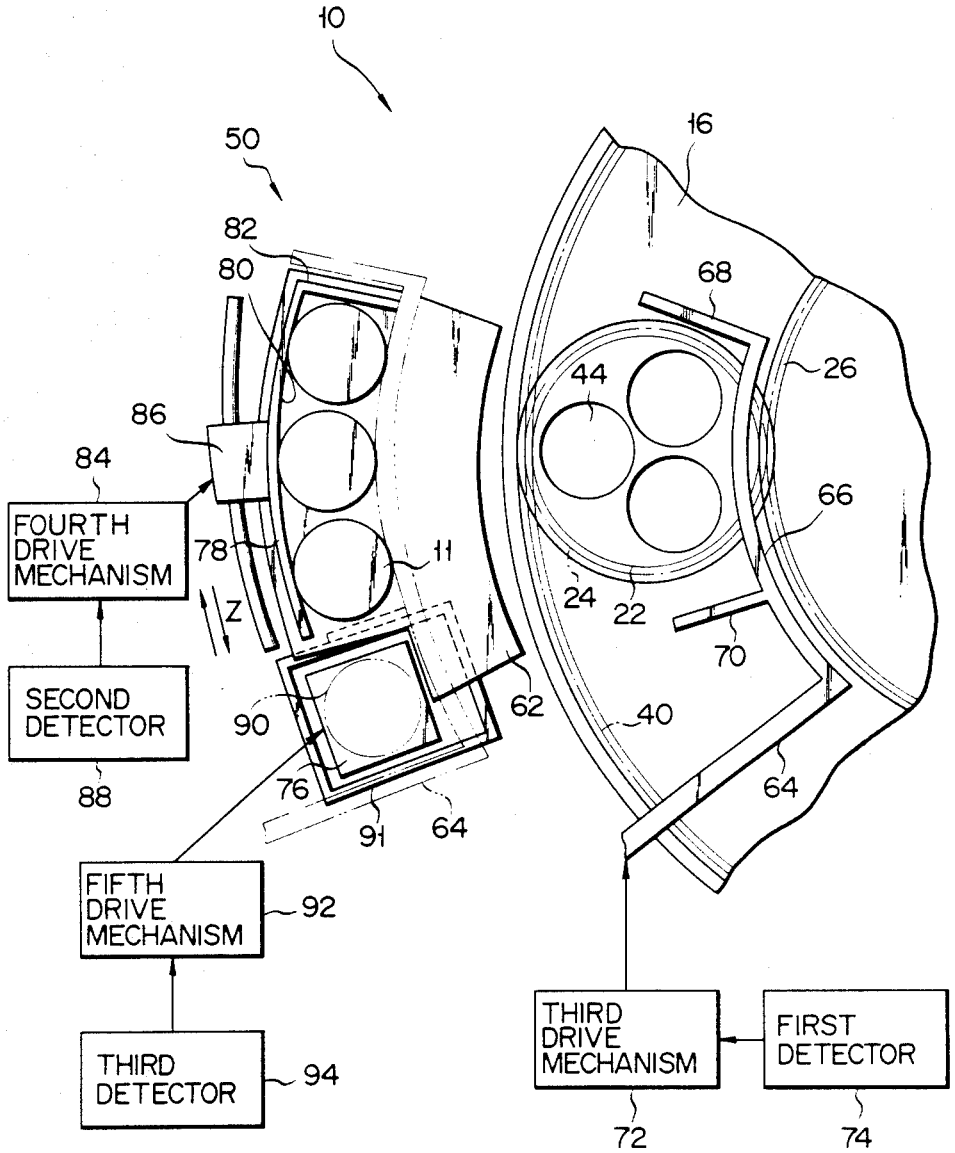
FIG. 2 is a partial plan view schematically showing the principal part of the lapping apparatus of FIG. 1.

The annular surface of the lower lapping plate 12 has a lower polishing member 16 which carries wafers 11 so as to polish the mounting surfaces (or lower surfaces) thereof. The lower polishing member 16 is made of, e.g., synthetic leather. The lower lapping plate 12 is coupled to a first rotary mechanism 17 to be rotated thereby in the direction of arrow M. A shaft hole 20 for a shaft 18 is bored through the central portions of the lower lapping plate 12 and the polishing member 16. At the upper end portion of the shaft 18 a sun gear 26 is formed which is capable of meshing with gear teeth 24 formed on a carrier 22 to be mentioned later. The lower end portion of the shaft 18 is coupled to a second rotary mechanism 28 for rotating the shaft 18 in the direction of arrow M. A rotating shaft 30 is axially passed through the shaft 18. A top portion 32 of the rotating shaft 30 has a key way (not shown), and projects above the sun gear 26 so as to be able to be fitted in the upper lapping plate 14. The lower end of the rotating shaft 30 is coupled to a third rotary mechanism 36 for rotating the rotating shaft 30 in the direction opposite to the rotating direction of the shaft 18 or the direction of arrow M. A vertically movable and rotatable casing 38 surrounds the lower lapping plate 12. An internal gear 40 in mesh with the gear teeth 24 of the carrier 22 is formed on the inner surface of the upper end portion of the casing 38. The lower end of the casing 38 is coupled to a first drive mechanism 42 for vertically moving the casing 38. Between the sun gear 26 and the internal gear 40 the carrier 22 made of epoxy resin capable of retaining the wafers 11 is provided. As shown in FIG. 2, the carrier 22 has three holes 44 at regular intervals in which the wafers 11 can be fitted. On the outer periphery of the carrier 22 gear teeth 24 are formed which can mesh with the sun gear 26 and the internal gear 40. Thus, as the sun gear 26 rotates, the carrier 22 rotates on its own axis while revolving around the sun gear 26. Located below the carrier 22 is a pushing ring 46 which supports both those portions of the carrier 22 adjoining the sun gear 26 and the internal gear 40 to force up the carrier 22. The pushing ring 46 includes inside arms 47 arranged in a loop around the sun gear 26 and outside arms 48 arranged between the lower lapping plate 12 and the casing 38 to surround the lower lapping plate 12. The outside arms 48 are arranged at regular intervals so that a space is defined at that portion which corresponds to an automatic collecting device 50 to be mentioned later. One end of the pushing ring 46 is coupled to a second drive mechanism 52 for rotating and moving the pushing ring 46 vertically, or along the axis of the shaft 18.

The upper lapping plate 14 has an upper polishing meber 54 which faces the lower polishing member 16 to polish the upper surfaces of the wafers 11. The upper polishing member 54 is made of, e.g., synthetic leather. The upper lapping plate 14 and the upper polishing member 54 are provided with a number of washing water holes 56 through which water for washing the wafers 11 is sprayed after the wafers are polished. Also, the upper lapping plate 14 and the upper polishing member 54 have a number of slurry holes 57 through which a slurry to serve as an abrasive is emitted for polishing the wafers 11. The washing water holes 56 and the slurry holes 57 are connected, respectively, to a washing water source 58 and a slurry source 59. The top of the upper lapping plate 14 is coupled to an air cylinder 60 which gradually moves the upper lapping plate 14 toward the lower lapping plate 12. The upper lapping plate 14 has a hollow 61 which can be connected with the top portion 32 of the rotating shaft 30. The hollow 61 is provided with a key way (not shown) capable of engaging the key way of the top end portion 32.

Outside the casing 38, the automatic collecting device 50 for automatically collecting the wafers 11 from the lower lapping plate 12 is disposed corresponding to the space between each two adjacent outside arms 48. As shown in FIGS. 1 and 2, the automatic collecting device 50 comprises a table 62 on which the wafers 11 are arranged in a line, and a first sweeper 64 for transferring the wafers 11 from the lower polishing member 16 to the table 62 after polishing. At one end of the first sweeper 64 a first collecting arm 66 is formed; it has a length about three times the diameter of each wafer 11. Both end portions 68 and 70 of the first collecting arm 66 project so as to embrace the three wafers 11 when the collection process is performed. The other end of the first sweeper 64 is coupled to a third drive mechanism 72 for moving the first sweeper 64 from the lower polishing member 16 toward the table 62. The third drive mechanism 72 is connected to a first detector 74 for detecting the completion of the wafer-polishing operation. The third drive mechanism 72 is actuated or stopped in respone to a detection signal from the first detector 74. In this embodiment, the wafer-polishing operation is terminated at a set time, so that the first detector 74 detects the completion of wafer-polishing by the use of a timer. On the table 62 there is disposed a second sweeper 78 for moving the wafers 11 which have been carried onto the table 62 by the first collecting arm 66 toward a carrier cassette 76 (to be mentioned later). The second sweeper 78 is L-shaped, extending along the peripheral edge of the table 62 on one side thereof. The second sweeper 78 includes a first portion 80 abutting against the wafers 11 arranged in a line, and a second portion 82 which serves to press the wafers 11 toward the carrier cassette 76. The second sweeper 78 is coupled by means of a drive shaft 86 to a fourth drive mechanism 84 to be moved thereby in the direction of arrow N. The fourth drive mechanism 84 is connected to a second detector 88 of detecting that the first sweeper 64 has reached the position to bring the wafers 11 into contact with the second sweeper 78 on the table 62. The carrier cassette 76 adjoins the table 62 to receive the wafers 11 one by one. The carrier cassette 76 is provided with a multitude of holder cases 90 arranged in layers at regular intervals and capable of vertical motion. Under the carrier cassette 76 there is disposed a pure water tank 91 filled with pure water in which the carrier cassette 76 is immersed. The carrier cassette 76 is coupled to a fifth drive mechanism 92 to be driven thereby in the vertical direction. The fifth drive mechanism 92 is coupled to a third detector 94 which delivers a detection signal when it detects that each wafer 11 is located in position in the carrier cassette 76 by the second sweeper 78.

The operation of the lapping apparatus 10 according to the one embodiment of the invention will now be described.

The wafers 11 to be polished are fitted individually in the holes 44 of the carrier 22, and are laid on the lower polishing member 16 so that the gear teeth 24 of the carrier 22 are in mesh with the sun gear 26 and the internal gear 40. Then, the air cylinder 60 is actuated to superpose the upper lapping plate 14 on the lower lapping plate 12 so that the carrier 22 and the wafers 11 are held on both their upper and lower sides between the lapping plates 14 and 12. The air cylinder 60 also absorbs the shock exerted on the upper lapping plate 14 when the upper lapping plate 14 comes in contact with the wafers 11 supported on the lower lapping plate 12. Thereafter, the slurry (as the abrasive) is supplied from the slurry source 59 through the slurry holes 57. Then, the first, second and third rotary mechanisms 17, 28 and 36 are actuated to rotate the sun gear 26, the rotating shaft 30, and the lower lapping plate 12 in their respective directions. Thus, the upper polishing member 54 attached to the upper lapping plate 14 and the lower polishing member 16 attached to the lower lapping plate 12 rotate in opposite directions, and the carrier 22 in mesh with the sun gear 26 rotates on its own axis while revolving around the sun gear 26 in the rotating direction of the lower polishing member 16. In this embodiment, the abrasive or slurry is supplied to the wafers 11 at a rate of 1 l/min. The wafers 11 are polished for approximately thirty minutes at a polishing temperature of 30° C. to 40° C. and at a fixed pressure.

After the polishing operation, the supply of the abrasive is stopped and the air cylinder 60 is actuated to separate the upper lapping plate 14 from the lower lapping plate 12 by approximately 2 to 3 mm. Then, the washing water is ejected from the washing water holes toward the wafers 11. This washing operation releases the wafers 11 from their close contact with the carrier 22.

After the supply of the washing water is stopped, the second drive mechanism 52 is actuated to raise and rotate the pushing ring 46, thereby separating the carrier 22 from the lower polishing member 16 on the lower lapping plate 12. The outside arm 48 is kept away from the space between the automatic collecting device 50 and the lower lapping plate 12. As a result, the wafers 11 are left on the lower polishing member 16. At the same time, the upper lapping plate 14 is further raised and stopped at a predetermined position.

Subsequently, the casing 38 is lowered about 30 mm below the surface of the lower polishing member 16 by the action of the first drive mechanism 42.

Then, the third drive mechanism 72 is actuated with a time lag after the first detector 74 detects the completion of the polishing operation. When the third drive mechanism 72 is operated, the first sweeper 64 moves on the lower polishing member 16 from the table 62 toward the sun gear 26. Thus, the first sweeper 64 is located beyond the three wafers 11 so that the wafers 11 are embraced by the first collecting arm 66. Thereafter, the first sweeper 64 is brought into close contact with the surface of the polishing member 16, and is then withdrawn toward the table 62. The three wafers 11 collide with one another to be arranged in a line along the first collecting arm 66 while the first sweeper 64 is moving. The wafers 11 are moved until they abut against the second sweeper 78 located on the table 62, that is, until the extreme end of the second portion 82 of the second sweeper 78 abuts against the first collecting arm 66. When the extreme end of the second portion 82 abuts against the first collecting arm 66, a space is defined between the first and second sweepers 64 and 78 so that the three wafers 11 are arranged in a row in the space, as indicated by a two-dot chain line in FIG. 2. When the three wafers 11 are arranged along the first portion 80 of the second sweeper 78, the lower lapping plate 12 is rotated through a given angle to set the next three wafers 11 in the position corresponding to the table 62. Then, the first sweeper 64 moves toward the sun gear 26 to be set in position to house the next three wafers 11, as mentioned before.

When the second detector 88 detects the contact between the first and second sweepers 64 and 78, it delivers a signal to actuate the fourth drive mechanism 84 after a time lag. When the fourth drive mechanism 84 is operated, the second sweeper 78 moves toward the carrier cassette 76. Since the second portion 82 of the second sweeper 78 pushes the wafers 11 along the direction of their arrangement, the wafers 11 move on the table 62 abutting against one another. When the wafer 11 nearest to the carrier cassette 76 reaches a predetermined position, the third detector 94 detects this wafer 11 and actuates the fifth drive mechanism 92. When the fifth drive mechanism 92 is operated, the carrier cassette 76 rises from the pure water tank 91 to the position where the lowermost one of the multistage holder cases 90 is flush with the table 62.

Meanwhile, the first wafer 11 is further pushed by the second sweeper 78 to be transferred to the lowermost one of the holer cases 90 of the carrier cassette 76. When the first wafer 11 is housed in the lowermost one of the holder cases 90, the carrier cassette 76 is moved down to the position where the next one of the holder cases 90 is flush with the table 62. As the second sweeper 78 moves on, the second wafer 11 is housed in the next one of the holder cases 90. When all the wafers 11 on the table 62 are housed in the carrier cassette 76 in this manner, the carrier cassette 76 is brought down into the pure water tank 91 to immerse the wafers 11 in the pure water.

As the same operations are repeated, all the wafers 11 on the lower polishing member 16 are housed in the carrier cassette 76. When all the wafers 11 are collected in the carrier cassette 76 and immersed in the pure water in the pure water tank 91, another empty carrier cassette 76 is set in position, and all operations are stopped.

Thereafter, by repeating the same operations, a number of wafers 11 can be polished on both sides, and can be automatically collected in the carrier cassette 76 at a very high speed.

This invention is not limited to the aforementioned embodiment, and various changes and modifications may be effected therein by one skilled in the art without departing from the scope or spirit of the invention.

Although three wafers are processed at one time in the above embodiment, four, five or six wafers may be polished together without degrading the effect. In this case, the number of holes in the carrier and the size of the table and the sweepers should be set according to the number and size of wafers processed.

The objects of lapping are not limited to wafers, and may include ceramics, lens filters, glass sintered ferrites and others.

In the above embodiment, the collecting arm of the first sweeper and the first portion of the second sweeper are arcuated extending along the configuration of the lower lapping plate. Alternatively, however, they may be straight.

In the foregoing embodiment, moreover, the first, second and third detectors detect the positions of their corresponding members and deliver the detection signals therefor. The same effect may be obtained with the use of, for example, timers which deliver detection signals based on the passage of time.

What is claimed is:

1. An apparatus for simultaneously polishing and lapping opposing faces of each of a plurality of objects, comprising:

a. a rotatable lower lapping plate having a carrying surface for carrying the objects, the carrying surface having a first polishing member for polishing and lapping one face of each object;

b. a rotatable upper lapping plate having a second polishing member to polish the other face of each object, the upper lapping plate being capable of abutting against the other faces of the objects laid on the first polishing member;

c. a carrier positioned between said upper lapping plate and said lower lapping plate and having holes to hold each object, said carrier capable of being set on the carrying surface of the lower lapping plate to retain each object on the carrying surface during polishing and lapping;

d. washing water supply means for supplying washing water between the upper lapping plate and the lower lapping plate to clean the objects on the lower lapping plate after polishing and lapping said objects;

e. a carrier transfer means for lifting up the carrier from the carrying surface after polishing and lapping, leaving the objects lying on the carrying surface;

f. collecting means adjacent said lower lapping plate and including a first sweeper and a second sweeper, said first sweeper being movable in a first direction to arrange the objects remaining on the carrying surface in a line, and said second sweeper being movable in a second direction substantially parallel to said line of objects to move said objects toward one end of said line; and g. a cassette positioned at the one end of said line to receive the objects being moved by said second sweeper.

2. An apparatus according to claim 1, wherein said upper lapping plate is provided with a first drive mechanism for moving the upper lapping plate toward or away from the lower lapping plate.

3. An apparatus according to claim 2, wherein said first drive mechanism includes an air cylinder.

4. An apparatus according to claim 1, wherein said washing water supply means includes a plurality of water holes formed in the upper lapping plate and the first polishing member, and a washing source connected to the water holes.

5. An apparatus according to claim 1, wherein said carrier transfer means includes a pushing member located under the carrier and capable of engaging part of the carrier, and a second drive mechanism for lifting the pushing member into contact with the carrier and for rotating the pushing member to keeping it away from the space between the collecting means and the lower lapping plate.

6. An apparatus according to claim 1, wherein said cassette includes holder cases in layers for storing each object one after another.

7. An apparatus according to claim 6, wherein said cassette includes a liquid tank filled with a liquid so that said holder cases can be immersed in the liquid.

8. An apparatus according to claim 7, wherein said cassette is provided with an object detector for detecting each object transferred to said holder cases and delivering a detection signal, and a third drive mechanism for receiving the detection signal from the object detector and driving the cassette to position said holder cases to receive the next object to be housed in the cassette.

9. An apparatus according to claim 1, wherein said collecting means includes a table adjacent the lower lapping plate, said first sweeper arranges the objects in a line and moves said objects onto the table, and said second sweeper moves the arranged objects on the table toward the cassette.

10. An apparatus according to claim 9, wherein said first sweeper is provided with a first detector for detecting the completion of polishing of the objects and delivering a signal, and a fourth drive mechanism for receiving the signal from the first detector and moving the first sweeper from the first polishing member toward the table.

11. An apparatus according to claim 10, wherein said second sweeper is provided with a second detector for detecting the location of the objects in the line on the table and delivering a signal, and a fifth drive mechanism for moving the second sweeper along the line toward the cassette.

12. An apparatus according to claim 11, wherein said objects of polishing and lapping are silicon wafers.

* * * * *